US009797557B2

(12) United States Patent
White

(10) Patent No.: US 9,797,557 B2
(45) Date of Patent: Oct. 24, 2017

(54) MULTIFUNCTION TORCH

(71) Applicant: Lamplight Farms Incorporated, Menomonee Falls, WI (US)

(72) Inventor: Ron White, North Prairie, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 219 days.

(21) Appl. No.: 14/668,281

(22) Filed: Mar. 25, 2015

(65) Prior Publication Data

US 2016/0281945 A1 Sep. 29, 2016

(51) Int. Cl.

| | |
|---|---|
| ***F21L 27/00*** | (2006.01) |
| *F21V 37/00* | (2006.01) |
| *F23D 3/18* | (2006.01) |
| *F21V 35/00* | (2006.01) |

(52) U.S. Cl.

CPC ..... *F21L 27/00* (2013.01); *F21V 35/00* (2013.01); *F21V 37/00* (2013.01); *F23D 3/18* (2013.01)

(58) Field of Classification Search

CPC . F21V 37/00; F21V 35/00; F23D 3/02; F23D 3/18

USPC ..... 431/253, 289, 290, 2, 310; 362/161

See application file for complete search history.

(56) References Cited

U.S. PATENT DOCUMENTS

| | | | |
|---|---|---|---|
| D25,976 | S | 8/1896 | Shaw |
| 613,188 | A | 10/1898 | Cadwallader et al. |
| 1,299,977 | A | 4/1919 | McGuire |
| 1,345,960 | A | 7/1920 | Rosenberger |
| 1,367,921 | A | 2/1921 | Pomije |
| 1,705,877 | A | 3/1929 | Ramsey |
| D101,041 | S | 9/1936 | Janssen |
| 2,056,617 | A | 10/1936 | Oberlander |
| 2,812,653 | A | 11/1957 | Meunier |
| 3,244,872 | A | 4/1966 | McCormick |
| 3,327,108 | A | 6/1967 | Press |
| D220,642 | S | 5/1971 | Morehead |
| D221,585 | S | 8/1971 | Moore |
| 3,603,784 | A | 9/1971 | Wellhofer |
| 3,790,772 | A | 2/1974 | Newman et al. |
| 4,117,533 | A | 9/1978 | Hagelthorn |
| 4,163,333 | A | 8/1979 | Kwiatkowski |
| D254,695 | S | 4/1980 | Bobrovniczky |
| D262,999 | S | 2/1982 | Spencer |
| 4,787,017 | A | 11/1988 | Vrettos |

(Continued)

FOREIGN PATENT DOCUMENTS

| | | |
|---|---|---|
| JP | 2002-329402 | 11/2002 |
| WO | WO2005022035 | 3/2005 |
| WO | PCT/US2016/024212 | 6/2016 |

*Primary Examiner* — Gregory Huson
*Assistant Examiner* — Nikhil Mashruwala
(74) *Attorney, Agent, or Firm* — David G. Woodral; Gable Gotwals

(57) ABSTRACT

A multifunction decorative torch comprising has a base providing an upwardly directed light, a cap supporting a liquid fueled torch insert having a wick and a fuel reservoir, and an outer wall supporting the cap and defining an interior space between the base and cap. The upwardly directed light illuminates the outer wall from within the interior space. The liquid fueled torch insert is supported by the cap such that the wick burns outside the interior space between the base and cap and the fuel reservoir is at least partially inside the interior space between the base and cap.

15 Claims, 5 Drawing Sheets

(56) References Cited

U.S. PATENT DOCUMENTS

| | | | | |
|---|---|---|---|---|
| 5,101,328 | A | 3/1992 | Hai | |
| 5,255,169 | A | 10/1993 | Koch | |
| D383,555 | S | 9/1997 | Hardy | |
| 5,683,239 | A | 11/1997 | Cardosi | |
| 5,797,671 | A | 8/1998 | Gess | |
| 5,879,191 | A * | 3/1999 | Burris | H01R 9/0521 439/271 |
| D412,213 | S | 7/1999 | Andujar | |
| D429,018 | S | 8/2000 | De'Armond | |
| D430,334 | S | 8/2000 | Hsu | |
| D442,302 | S | 5/2001 | Hsu | |
| 6,290,914 | B1 | 9/2001 | LeJeune et al. | |
| 6,305,826 | B1 | 10/2001 | Yang | |
| D457,979 | S | 5/2002 | Chen | |
| 6,435,694 | B1 | 8/2002 | Bell et al. | |
| 6,468,071 | B2 | 10/2002 | Zou | |
| 6,474,980 | B2 | 11/2002 | LaVanier | |
| D469,203 | S | 1/2003 | DiPasquale | |
| D470,968 | S | 2/2003 | Kuelbs et al. | |
| 6,520,770 | B2 | 2/2003 | Zou | |
| 6,551,365 | B2 | 4/2003 | Berger et al. | |
| 6,554,448 | B2 | 4/2003 | Carpenter et al. | |
| D482,478 | S | 11/2003 | Cheong et al. | |
| D483,895 | S | 12/2003 | Kuelbs et al. | |
| D486,925 | S | 2/2004 | Cuevas et al. | |
| 6,705,741 | B2 | 3/2004 | Bonnema et al. | |
| 6,716,026 | B1 | 4/2004 | Beougher | |
| 6,736,530 | B2 | 5/2004 | Thevenot | |
| 6,758,666 | B1 | 7/2004 | Strunak | |
| D500,876 | S | 1/2005 | Bucher et al. | |
| 6,869,200 | B1 | 3/2005 | Graham | |
| 6,960,320 | B1 | 11/2005 | Smith et al. | |
| 7,204,618 | B1 | 4/2007 | Kuelbs et al. | |
| D542,434 | S | 5/2007 | Schofield | |
| D542,965 | S | 5/2007 | Layne | |
| D550,891 | S | 9/2007 | Miranda | |
| 7,314,293 | B2 | 1/2008 | Steier et al. | |
| D563,585 | S | 3/2008 | Lee et al. | |
| 7,377,667 | B2 | 5/2008 | Richmond | |
| 7,658,608 | B2 | 2/2010 | Weathersbee | |
| 8,215,789 | B2 | 7/2012 | Howard | |
| 8,342,839 | B2 | 1/2013 | Rindom | |
| 8,708,515 | B2 | 4/2014 | White | |
| 9,062,835 | B2 | 6/2015 | White | |
| 2001/0036069 | A1 | 11/2001 | Franks | |
| 2002/0032982 | A1 | 3/2002 | Berger et al. | |
| 2002/0080604 | A1* | 6/2002 | Niermann | F21S 6/00 362/173 |
| 2003/0036030 | A1* | 2/2003 | Doppelt | F23D 3/30 431/316 |
| 2003/0131506 | A1 | 7/2003 | Frazer | |
| 2007/0236948 | A1 | 10/2007 | Restell | |
| 2007/0242451 | A1 | 10/2007 | Richmond | |
| 2007/0248922 | A1 | 10/2007 | Mahdavieh | |
| 2007/0297166 | A1* | 12/2007 | Chen | F21S 6/001 362/161 |
| 2009/0027871 | A1 | 1/2009 | Chadha | |
| 2009/0080203 | A1 | 3/2009 | McCauley | |
| 2009/0081600 | A1 | 3/2009 | Weathersbee | |
| 2009/0129066 | A1 | 5/2009 | Chadha | |
| 2012/0251962 | A1 | 10/2012 | White | |
| 2013/0027918 | A1 | 1/2013 | White | |
| 2013/0288186 | A1 | 10/2013 | White | |
| 2015/0049470 | A1 | 2/2015 | Kimmel et al. | |
| 2016/0230983 | A1* | 8/2016 | Lynch | F21V 35/00 |

* cited by examiner

MULTIFUNCTION TORCH

FIELD OF THE INVENTION

The invention relates to decorative torches in general and, more particularly, to decorative torches having multiple modes of use.

BACKGROUND OF THE INVENTION

Consumers have had access to liquid fuel burning decorative torches for some time. Some of these are user refillable and may provide utility beyond mere decoration, such as pest repellence. However, many liquid fuel burning torches are unsuitable for indoor use. In addition, users may have had to choose between a large flame, and other decorative aspects that can be provided from a smaller, more recessed flame, such as back lighting of a decorative pattern.

Light emitting diode (LED) devices can be utilized for decorative purposes, and are now sufficiently efficient to provide many hours of illumination from a single battery or set of batteries. However, most LEDs sufficiently powerful to provide usable lighting effects are not pleasant for direct viewing. They are highly efficient but still do not replicate the visually pleasing spectrum of a combusting fuel. Moreover, LEDs do not directly provide utility beyond their appearance. By design and due to their inherent efficiency, they do not produce sufficient waste heat to activate insect repellants, scents, or other chemicals.

What is needed is a system for addressing the above, and related, concerns.

SUMMARY OF THE INVENTION

The invention of the present disclosure, in one aspect thereof, comprises a multifunction decorative torch having a base providing an upwardly directed light. A cap supports a liquid fueled torch insert having a wick and a fuel reservoir. An outer wall supports the cap and defines an interior space between the base and cap. The upwardly directed light illuminates the outer wall from within the interior space. The liquid fueled torch is supported by the cap such that the wick burns outside the interior space between the base and cap and the fuel reservoir is at least partially inside the interior space between the base and cap.

In some embodiments, a lighting insert interposes the outer wall and the upwardly directed light such that the upwardly directed light shines through the insert to illuminate the outer wall. The lighting insert may be decorative so as to impart a pattern to the light shining therethrough. The outer wall may be transparent. In other embodiments, the outer wall provides a pattern therein that is viewable outside the wall the when the outer wall is illuminated by the upwardly directed light.

In some embodiments, the upwardly directed light comprises a plurality of light emitting diodes (LEDs) selectively emitting a plurality of different visible colors. A battery compartment may be located in the base. The base may include a user control for selectively activating the LEDs.

The liquid fueled torch may further comprise a skirt that fits onto the cap and retains the liquid fueled torch a predetermined distance above the base. The skirt may have a threaded and removable connection to the fuel reservoir. The skirt may define a wick holder for the wick.

The invention of the present disclosure, in another aspect thereof, comprises a multifunction decorative torch having a base with a plurality of lights, a cap with a liquid fueled torch having a wick and a fuel reservoir, and an outer wall supporting the cap above the base and defining an interior portion. The reservoir is supported at least partially inside the interior portion. The reservoir remains a predetermined distance above the base and has a predetermined width sufficiently less than the width of the interior portion that the plurality of lights in the base fully illuminates the outer wall along the interior portion that is occupied by the reservoir.

In some embodiments, the plurality of lights comprise a plurality of light emitting diodes (LEDs) that selectively illuminate the interior portion with a plurality of different visible colors. A user control may be provided on the base that selectively activates the plurality of LEDs.

The device may further comprise a decorative insert placed next to the outer wall in the interior portion such that the plurality of lights illuminate the decorative insert. The outer wall may provide a pattern thereon that is viewable outside the wall the when the outer wall is illuminated from the interior portion.

The invention of the present disclosure, in another aspect thereof, comprises a multifunction decorative torch with a cylindrical outer wall defining an interior and an exterior of the multifunction decorative torch, a base supporting the cylindrical outer wall and having a plurality of user activated LEDs placed within the base to selectively illuminate the interior portion, and a liquid fuel burning insert having a fuel burning wick at least partially inserted into a axially symmetric fuel reservoir, the fuel reservoir being supported relative to the outer wall and situated at least partially within the interior defined by the cylindrical outer wall. The fuel reservoir is sized and supported such that every portion of the outer wall adjacent to the fuel reservoir may be illuminated by at least one of the plurality of LEDs without shadow from the fuel reservoir.

In some embodiments, the multifunction decorative torch further comprises a cap interposing the liquid fuel burning insert and the outer wall. The cap supports the fuel burning insert relative to the wall and the base. A decorative insert may be provided adjacent to the outer wall such that the decorative insert is selectively illuminated by the plurality of LEDs. The outer wall may be masked to provide an illuminated pattern to the exterior when the interior is illuminated. The LEDs may illuminate the interior from within the base through an opening in the base provided with a protective cover.

DETAILED DESCRIPTION OF THE PREFERRED EMBODIMENTS

Figure 1:
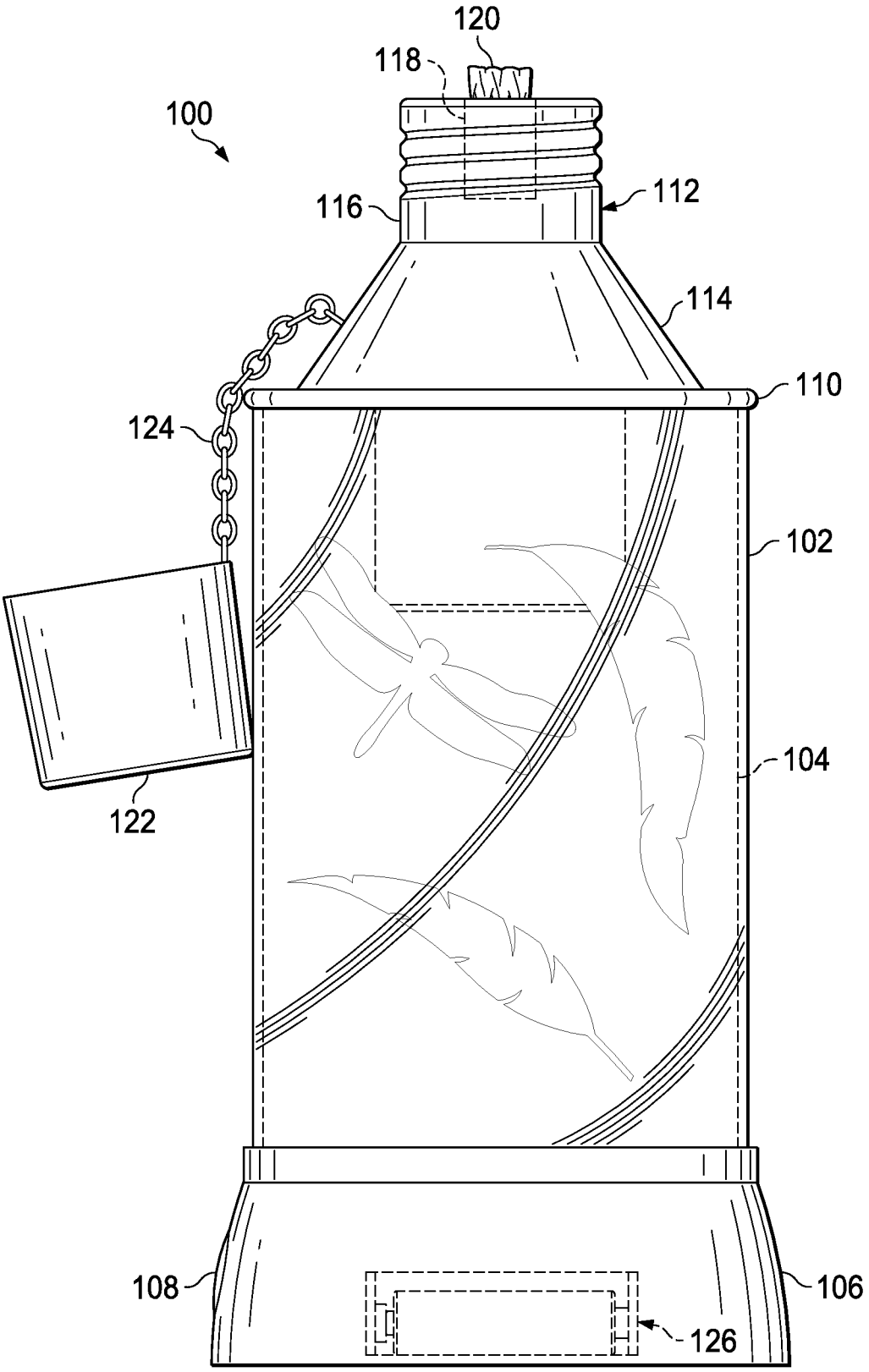
FIG. 1 is a side view of a multifunction decorative torch according to aspects of the present disclosure.
Figure 2:
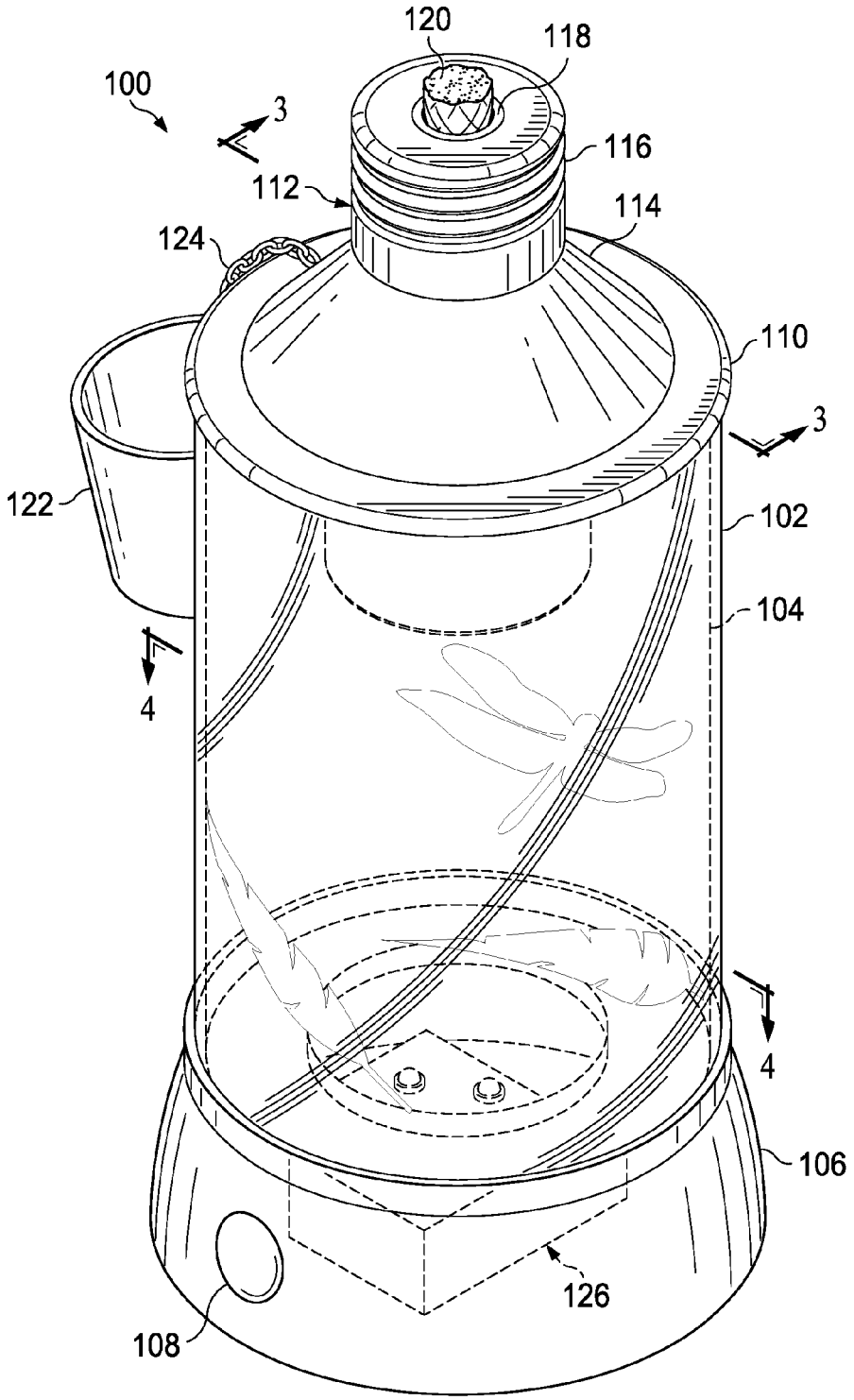
FIG. 2 is a perspective view of the torch of FIG. 1.

Referring now to FIG. 1, a side view of a multi-function decorative torch according to aspects of the present disclosure is shown. Referring also to FIG. 2, a side perspective view of the torch of FIG. 1 is shown. The torch 100 comprises a wall 102. The wall 102 may comprise glass or plastic or another transparent or translucent material. In the illustrated embodiments, the wall 102 is cylindrical. However, in other embodiments, the wall 102 may take on other shapes, (e.g., it could be rectilinear). The wall 102 defines interior (302 FIG. 3) and an exterior of the torch 100.

Behind the wall 102, within the interior 302, a lighting insert 104 may be provided. The insert 104 may be a decorative insert comprising plastic, paper, or another decorative material. It may be partially transparent or translucent and may have decorative patterns printed or otherwise provided thereon. In some embodiments, the insert 104 may simply be a flat, rectangular sheet of material that is rolled and placed inside the cylindrical wall 102 where it will remain adjacent to the wall 102 for decorative purposes, as described herein. The insert 104 may be viewed through the transparent wall 102 or it may be selectively illuminated from within as described further below.

The wall 102 is supported by a base 106. The base 106 may be constructed from a polymer or a metal alloy or a combination thereof. The base 106 provides a supporting platform for the wall 102 and the insert 104. The base 106 can be painted or decorated as well. In some embodiments, the wall 102 may be affixed to the base 106 by a glue or other means.

Atop the wall 102, opposite from the base 106, may be a cap 110. The cap 110 may be a metal, a polymer, or a combination thereof, and can also be decorated. In some embodiments, the cap 110 is affixed onto the wall 102 by an adhesive or other means. In normal use, the cap 110 may remain affixed to the wall 102, and may retain the decorative insert 104 in place within the outer wall 102.

The cap 110 may support and provide location for a liquid fuel burning torch insert 112. From the views provided in FIGS. 1 and 2, it can be seen that the insert 112 provides a skirt 114 that also functions as a cap or lid for the insert 112. The skirt 114 also rests upon the cap 110. A neck 116 is provided on the skirt 114 and provides a wick holder 118 into which a wick 120 may be placed for burning liquid fuels. The skirt 114 and neck 116 may be integrally formed and may comprise, for example, rolled sheet metal. The skirt 114 and other components of the insert 112 may be painted other otherwise decorated. The wick 120 may be a long-term use fiberglass wick. In some embodiments, a cap or snuffer 122 may be provided for protecting the wick 120 and/or extinguishing the flame. In some embodiments, the snuffer 122 may be tethered to the insert 112 via a chain 124, for example.

The base 106 may provide certain illumination features, as described in greater detail below. To that end, a user control 108 may be provided on the exterior of the base 106. In the present embodiment, the control 108 is a push button. However, in other embodiments, the control 108 could be a switch, slider, or other control mechanism. In some embodiments, the illumination effects are battery powered. The base 106 may also provide a user accessible battery compartment 126.

Figure 3:
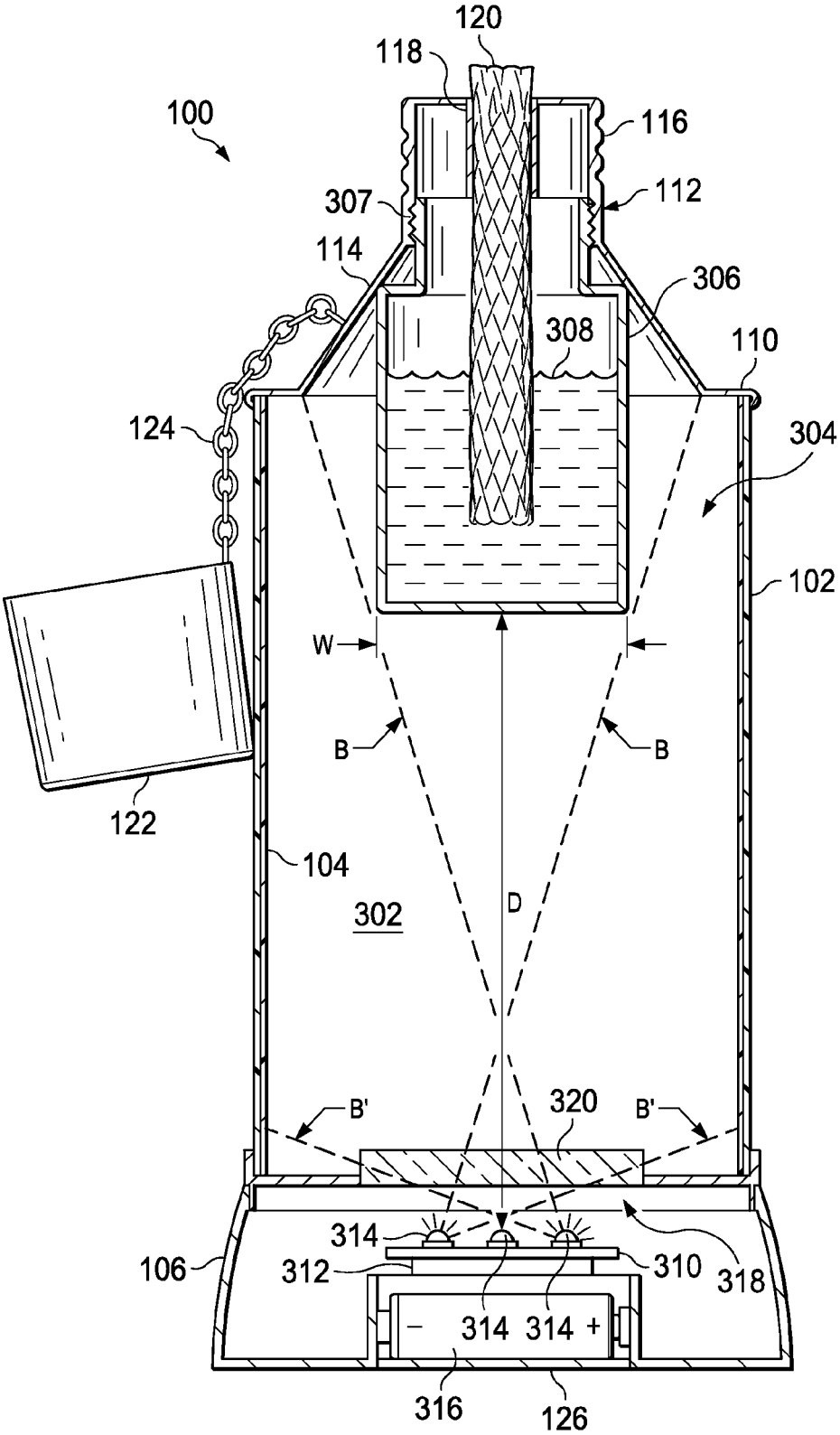
FIG. 3 is a side cutaway view of the torch of FIG. 1

Referring now to FIG. 3, a side cutaway view of the torch 100 is shown. In FIG. 3, the relationship between the outer wall 102 and the decorative insert 104 can be better appreciated. The interior portion defined by the outer wall 102 is denoted at 302 in FIG. 3. It can also be appreciated from FIG. 3 that the decorative insert 104 lies generally against the interior surface of the outer wall 102 such that the interior portion 302 is generally empty.

The skirt 114 of the fuel burning insert 112 can be seen supporting a fuel reservoir 306. The fuel reservoir 306 is supported, at least partially (and up to substantially), within the interior portion 302 defined by the outer wall 102. In the present embodiment, the fuel reservoir 306 is radially symmetric (neglecting any printing or other superficial external features). The reservoir 306 has a predetermined diameter or width "W" such that, even though it may substantially occupy a portion of the interior 302, a void or annulus 304 will exist between the reservoir 306 and the insert 104 and/or outer wall 102.

The insert 112 may be user serviceable. To that end, it may be removable from the cap 110. In some embodiments, the insert 112 is held in place simply by gravity. The neck 116 of the skirt 114 may have interior threads that fit onto a threaded neck 307 affixed to the fuel reservoir 306. With the insert 112 is removed from the cap 110, the skirt 114 (or lid) may be unscrewed from the fuel reservoir 306 to facilitate filing or refilling.

The reservoir 306 may contain a quantity of liquid torch fuel 308. The wick 120 may be held at least partially within the fuel supply 306 via the wick holder 118. The wick holder 118 may provide a friction fit for the wick 120. As the wick 120 may be a long lasting fiberglass type wick, it is not contemplated that frequent adjustments of the wick are needed.

The base 106 can be seen to contain a light board 310 and a control circuit 312. The light board 310 may be a circuit board onto which are mounted a plurality of lights 314. In the present embodiment, the lights 314 are surface-mount type light emitting diodes (LEDs). However, various embodiments of the present disclosure would work equally well, if perhaps less efficiently, with incandescent type bulbs. The lights 314 may be affixed to the board or otherwise placed such that they provide light above the base 106 (e.g., they are upwardly shining or upwardly directed).

The control circuit 312 may be integral with the light board 310 and may provide the necessary voltage regulation and control circuitry to operate the lights 314. The control circuit 312 may interface with one or more batteries 316 in the battery compartment 126 and/or the user control 108 of FIGS. 1 and 2.

The lights 314 may be at least partially recessed into the base 106 such that they shine through an internally defined opening 318 to illuminate the interior portion 302. In some embodiments, a transparent, or at least translucent, cover 320 may be provided over the opening 318. As discussed, the insert 112 may be removed from the torch 100 such that the interior 302 is accessible. The cover 320 prevents items from being lost into the base 106 and may also prevent a fuel spill from damaging the lights 314, the control circuit 312, or other components within the base 106.

The lights 314 may be configured to selectively illuminate or provide various flashing or fading effects. For example, in one embodiment, a single press of the user control button 108 may activate a white light while a second press may activate a colored light and third press may turn the torch 100 off. It is understood that the embodiments of the present disclosure are not meant to be limited to any particular light color or lighting effect. For example, light effects may include steady state, strobing, flashing, fading, cross-color fading, and other effects.

In order to provide a device that is useful as both a liquid fuel burning apparatus and an electrically powered internally lighted device, it may be desirable to insure that substantially all of the outer wall 102 and/or decorative insert 104 can be illuminated even when the fuel burning insert 112 is in place. To that end, the dimensions of the various components of the device 100 and their relationship to one another may be carefully selected. As described, the fuel reservoir 306 has a diameter or width "W". However, the reservoir 306, the skirt 114, and/or the height of the wall 102 may be such that a minimum distance "D" is provided between the bottom of the reservoir 306 and the top of the lights 314. The dashed lines "B" of FIG. 3 illustrate how even the most remote light 314 from an opposite wall will at least partially illuminate the relevant portion of the wall 102. This is owing in part to the free space or annulus 304 between the fuel reservoir 306 and the decorative insert 104 or wall 102, and the distance from the bottom of the fuel reservoir 306 to the light board B. The present disclosure is not meant to be limited to particular dimensions so long as those dimensions function as claimed herein.

The lines B' illustrate how the lights 314 can also illuminate all or substantially all of the wall 102 and/or decorative insert 104 near where they affix to the base 106. In order to eliminate or minimize any shadows resulting from the base at the lower portion of the wall 102, the lights 314 and/or light board 310 may elevated towards the opening 318.

Figure 4:
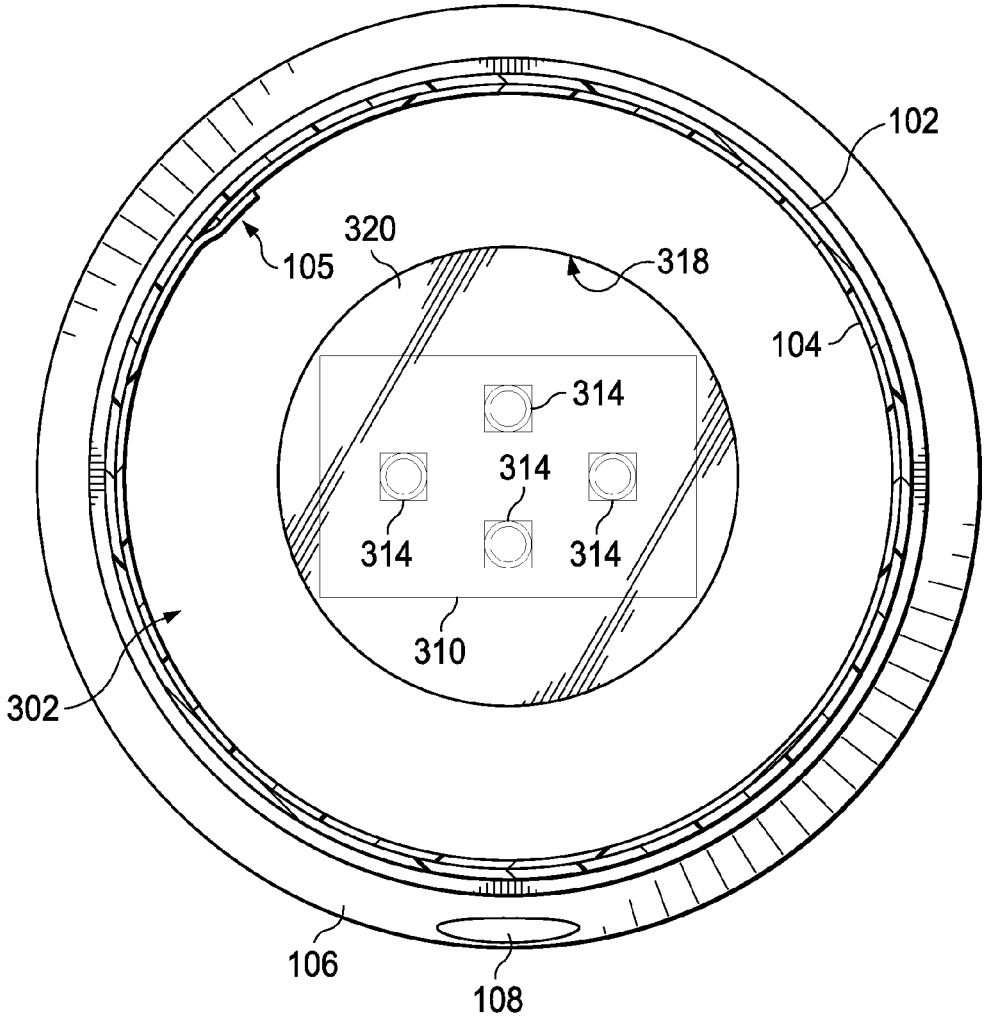
FIG. 4 is a top down view taken along the line 4-4 of FIG. 2.

Referring now to FIG. 4, a top down view of the torch 100 taken along the line 4-4 of FIG. 2 is shown. From the viewpoint of FIG. 4, the cylindrical wall 102 appears circular. The decorative insert 104 can be seen to lie interior to the wall 102 and adjacent thereto. Where the decorative insert 104 is a single rectangular sheet, it may be rolled and inserted into the wall 102 where it joins back to itself, for example, at 105.

The light board 310 can be seen through the opening 318 and the base 106. The cover 320 may serve to cover and protect the light board 310. In the present embodiment, four surface-mounted LEDs are provided as lights 314. The embodiments of the present disclosure are not meant to be limited to any particular number of lights 314. More or fewer than four could be utilized. The spacing and location of the lights 314 on the board 310 may be somewhat important, depending upon the embodiment, to insure that substantially all of the interior 302 can be at least partially illuminated. As discussed with respect to FIG. 3, the present embodiment, utilizing four lights 314, can be made to satisfy this criteria.

Figure 5:
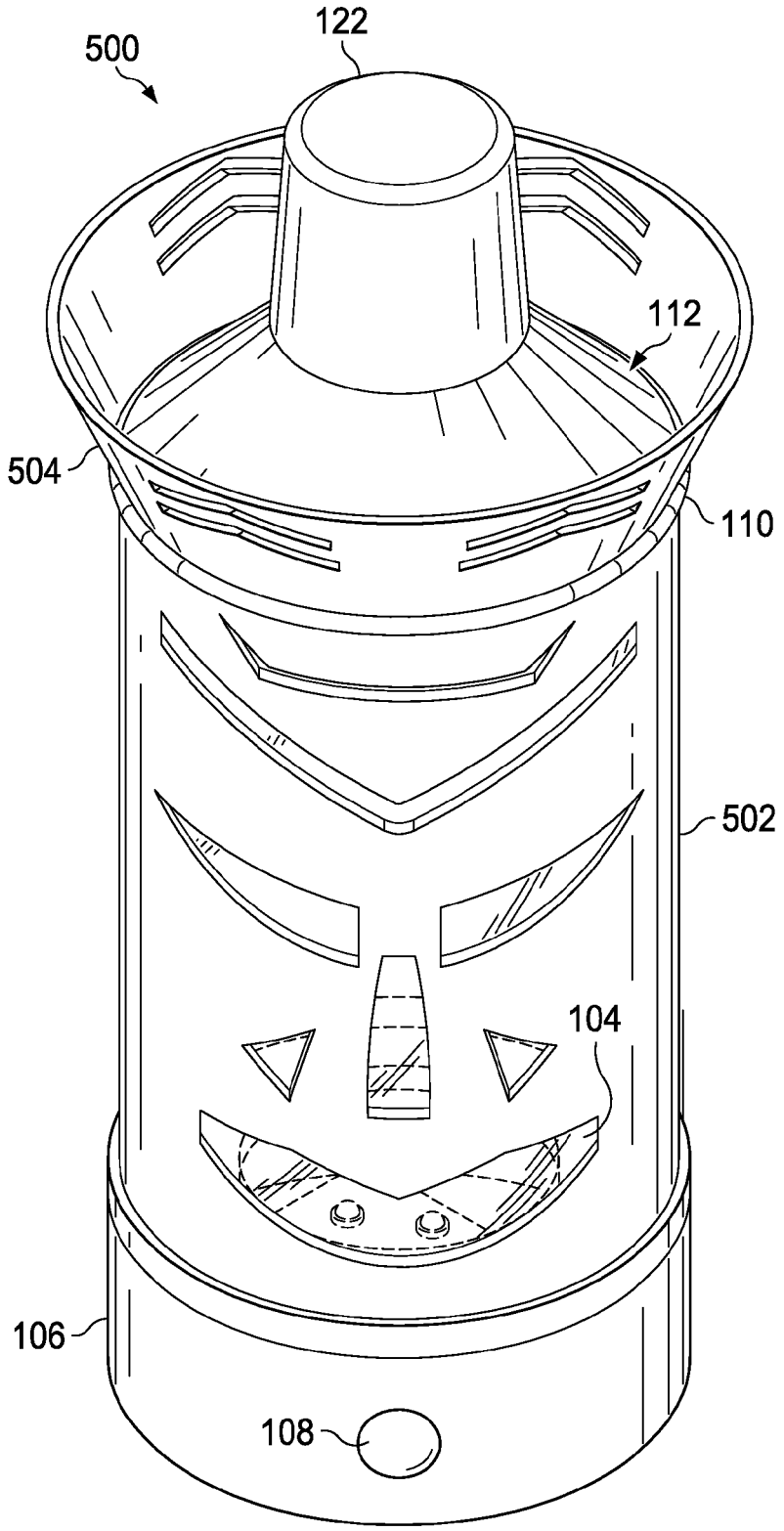
FIG. 5 is a perspective view of another a multifunction decorative torch according to aspects of the present disclosure.

Referring now to FIG. 5, a perspective view of another multi-function decorative torch 500 according to aspects of the present disclosure is shown. The torch 500 is substantially identical to the torch 100 of FIGS. 1-4, except as described below. The torch 500 comprises an outer wall 502 with a pattern provide therein. The wall 502 may have an opaque or translucent layer over a glass layer to provide the pattern shown. In some embodiments, the wall 502 is a single layer with no glass layer underneath.

Some embodiments include the decorative insert 104 while others do not. It will be appreciated that, when the torch 500 is illuminated from within, the pattern on the wall 502 may be viewed. Where the lights 314 are sufficiently powerful, the pattern on the wall 502 may be projected onto adjacent walls or other surfaces. It should be understood that the present disclosure is not meant to be limited to the illustrated patterns on either the decorative insert 104 or the outer wall 502.

The torch 500 also includes a decorative ring 504 that attaches to the cap 110. The decorative ring 504 may have a pattern cut therein such that the light from the liquid fueled flame shines therethrough and/or casts decorative shadows into adjacent areas. In other embodiments, the ring 504 may be sized and shaped so as to promote large flame effects from the fuel burning insert 112.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A multifunction decorative torch comprising:
- a base providing an upwardly directed light;
- a liquid fueled torch insert having a wick and a fuel reservoir;
- a cap supporting the liquid fueled torch insert; and
- an outer wall supporting the cap and defining an interior space between the base and cap;
- wherein the upwardly directed light is below and spaced apart from the fuel reservoir, and the fuel reservoir has a width providing a spacing between the outer wall and the fuel reservoir, such that the upwardly directed light illuminates the entirety of the outer wall surrounding the fuel reservoir from below the fuel reservoir; and
- wherein the liquid fueled torch insert is supported by the cap such that the wick burns outside the interior space between the base and cap and the fuel reservoir is at least partially inside the interior space between the base and cap.

2. The multifunction decorative torch of claim 1, further comprising a lighting insert interposing the outer wall and the upwardly directed light such that the upwardly directed light shines through the insert to illuminate the outer wall.

3. The multifunction decorative torch of claim 2, wherein the lighting insert is decorative so as to impart a pattern to the light shining therethrough.

4. The multifunction decorative torch of claim 1, wherein the outer wall is transparent.

5. The multifunction decorative torch of claim 1, wherein the outer wall provides a pattern therein that is viewable outside the wall the when the outer wall is illuminated by the upwardly directed light.

6. The multifunction decorative torch of claim 1, wherein the upwardly directed light comprises a plurality of light emitting diodes (LEDs) selectively emitting a plurality of different visible colors.

7. The multifunction decorative torch of claim 6, further comprising a battery compartment in the base and a user control for selectively activating the LEDs.

8. The multifunction decorative torch of claim 1, wherein the liquid fueled torch insert further comprises a skirt that fits onto the cap and retains the liquid fueled torch a predetermined distance above the base.

9. The multifunction decorative torch of claim 8, wherein the skirt has a threaded and removable connection to the fuel reservoir.

10. The multifunction decorative torch of claim 8, wherein the skirt defines a wick holder for the wick.

11. A multifunction decorative torch comprising:
- a cylindrical outer wall defining an interior and an exterior of the multifunction decorative torch;
- a base supporting the cylindrical outer wall and having a plurality of user activated LEDs placed within the base to selectively illuminate the interior; and
- a liquid fuel burning insert having a fuel burning wick at least partially inserted into a axially symmetric fuel reservoir, the fuel reservoir being supported relative to the outer wall and situated at least partially within the interior defined by the cylindrical outer wall;
- wherein the fuel reservoir is sized and supported such that every portion of the outer wall adjacent to the fuel reservoir may be illuminated by at least one of the plurality of LEDs without shadow from the fuel reservoir;

wherein the LEDs illuminate the interior from within the base through a single central opening in the base provided with a protective cover; and wherein the LED is below and spaced apart from the fuel reservoir, and the fuel reservoir has a width providing a spacing between the outer wall and the fuel reservoir, such that the LED illuminates the entirely of the outer wall surrounding the fuel reservoir from below the fuel reservoir.

12. The multifunction decorative torch of claim 11, further comprising a cap interposing the liquid fuel burning insert and the outer wall, the cap supporting the fuel burning insert relative to the wall and the base.

13. The multifunction decorative torch of claim 11, further comprising a decorative insert adjacent to the outer wall such that the decorative insert is selectively illuminated by the plurality of LEDs.

14. The multifunction decorative torch of claim 11, wherein the outer wall is masked to provide an illuminated pattern to the exterior when the interior is illuminated.

15. The multifunction decorative torch of claim 11, wherein the LEDs illuminate the interior from within the base through an opening in the base provided with a protective cover.

* * * * *